US005199819A

United States Patent [19]

Matiere

[11] Patent Number: 5,199,819

[45] Date of Patent: Apr. 6, 1993

[54] SEMI-BURIED STRUCTURE FORMED ON A MOUNTAINSIDE

[76] Inventor: Marcel Matiere, 17, avenue Aristide Briand, 15000 Aurillac, France

[21] Appl. No.: 719,008

[22] Filed: Jun. 21, 1991

[30] Foreign Application Priority Data

Jun. 22, 1990 [FR] France ..... 90 07877

[51] Int. Cl.[5] ..... E21D 9/00

[52] U.S. Cl. ..... 405/149; 405/151; 405/258; 52/88

[58] Field of Search ..... 405/124, 149, 151, 258, 405/286; 52/88

[56] References Cited

U.S. PATENT DOCUMENTS

| | | | |
|---|---|---|---|
| 853,204 | 5/1907 | Luten | 52/88 |
| 2,535,883 | 12/1950 | Williamson | 405/124 X |
| 3,282,056 | 11/1966 | Fisher | 405/286 |
| 4,685,829 | 8/1987 | Matiere | 405/124 |
| 4,798,499 | 1/1989 | Yamada | 405/286 |
| 4,836,714 | 6/1989 | Matiere | 405/124 X |

FOREIGN PATENT DOCUMENTS

| | | | |
|---|---|---|---|
| 0277399 | 10/1988 | European Pat. Off. . | |
| 510802 | 12/1920 | France . | |
| 1008441 | 5/1952 | France | 405/151 |
| 402919 | 5/1966 | Switzerland . | |

OTHER PUBLICATIONS

"Route de la Forclaz"-Ch. Cleusix, ing. EPF SIA, Sion-No. 6-Jun. 2, 1967.

"Ventilation"-No. 3 Mar. 11, 1974.

*Primary Examiner*—Dennis L. Taylor

*Assistant Examiner*—Arlen L. Olsen

*Attorney, Agent, or Firm*—Pollock, Vande Sande & Priddy

[57] ABSTRACT

A process for the construction of a semi-buried structure for the protection of a subgrade formed on a mountainside, and the structure thus constructed. The structure consists entirely of precast concrete elements forming a succession of adjacent sections, each consisting of three precast elements, respectively an upper covering element bearing, via longitudinal articulations, on two side elements comprising, respectively, a solid wall on the uphill side and at least one pillar on the downhill side, and each provided with a widened footing enabling the element simply to be placed on the ground, and with an upper portion in the form of a stringer on which are formed longitudinal portions for the articulated bearing of the corresponding lateral edge of the covering element. The invention applies, in particular, to the protection of highways or railroad tracks in mountainous locations.

4 Claims, 3 Drawing Sheets

SEMI-BURIED STRUCTURE FORMED ON A MOUNTAINSIDE

FIELD OF THE INVENTION

The subject of the invention is a process for the construction of a semi-buried structure forming a tunnel for the protection of a highway or a railroad track, constructed on a mountainside, and also, includes the structures thus constructed.

BACKGROUND OF THE INVENTION

It is often necessary, in uneven terrain, to form the subgrade of a highway or of a railroad track by the coast or at the foot of a piece of ground with a steep gradient, sometimes even a vertical cliff, for example at the exit of a tunnel.

Such a structure is intended essentially to protect the highway against landslides or avalanches. It must therefore consist, on the uphill side, of a solid wall which is joined to a covering enabling the landslides or avalanches to be held back or alternatively to pass over the top of the highway. On the downhill side, on the other hand, the covering generally bears on a wall pierced with orifices, often a series of pillars, so as to permit natural lighting of the highway and not to extend the tunnel purposelessly.

The covering must be able to sustain very substantial impacts caused, for example, by the fall of large blocks, and it is often preferred to give it the shape of a vault. Furthermore, it is preferably covered with an embankment which enables the impacts to be absorbed.

Such a structure must, however, also be able to sustain substantial lateral forces caused by the landslides and the avalanches.

Such structures have been known for some time.

U.S. Pat. No. 3,282,056 for example, discloses such protective tunnels, but these are constructed entirely from corrugated sheet metal panels which must be held in place by ties. Such panels do not have the same strength as a reinforced concrete wall and, in particular, the risks of corrosion do not give the structures constructed in this way sufficient durability. This is why the use of reinforced or prestressed concrete is normally preferred. For example, the journal "Route et Circulation Routière", No. 6, of June 2, 1967 shows a protective tunnel consisting of an arched concrete wall embedded in the ground on the uphill side and resting on a series of pillars on the downhill side.

Swiss Patent No. 402,919 likewise discloses a tunnel of this type, comprising a covering slab anchored in the rock wall on the uphill side and resting, on the downhill side, on a wall provided with movable panels enabling the downward pressure caused by the passage of an avalanche to be absorbed.

In the past, such structures were constructed using conventional techniques with reinforced concrete, in other words by casting in-situ, using forms and arch centers. These processes take a relatively long time and are relatively expensive.

In mountainous terrain, the season which is favorable for construction is very short. Moreover, workers and equipment are not fully protected against the rock falls or landslides which may occur during construction.

SUMMARY OF THE INVENTION

It is an object of the invention to overcome these difficulties by use of a process enabling such protective tunnels to be built very quickly and in complete safety.

The invention therefore relates, in a general manner, to the construction of a semi-buried structure for the protection of a subgrade extending on a mountainside along a longitudinal axis and comprising a covering bearing, on the uphill side, on a closed wall and, on the downhill side, on an open wall, for example a series of spaced pillars.

According to the invention, the protective structure consists entirely of precast concrete elements, each covering a portion of the cross-section and forming a succession of adjacent sections placed sequentially along the longitudinal axis, and each consisting of three precast elements, respectively an upper covering element bearing, via longitudinal articulations, on two side elements comprising, respectively, a solid wall on the uphill side and at least one pillar on the downhill side, and each provided with a base in the form of a widened footing with a plane lower face enabling the element simply to be placed on the ground, and with an upper portion in the form of a stringer on which are formed longitudinal portions for the articulated bearing of the corresponding lateral edge of the covering element.

In order to build such a structure according to the invention:

three series of precast elements are made in advance in a precasting factory, respectively uphill side elements comprising a plane wall extending between a widened base and an upper stringer, downhill side elements comprising at least one pillar extending between a widened base and an upper stringer, and upper covering elements, each consisting of a rigid shell extending between two parallel lateral edges, on which upper elements are formed longitudinal bearing portions capable of interacting with matching longitudinal portions formed on the upper face of the stringers of the side elements in order to form articulated bearings, at least a portion of the flattened subgrade is formed at the desired level, and at least one uphill side element, one downhill side element and one vault element are placed successively on the subgrade portion.

The invention takes advantage of the recent progress in precasting which makes it possible to make very strong precast elements having substantial dimensions. In particular, the inventor has already proposed, in European Patent 081,402, a technique for building underground structures such as ducts or bridges by means of precast elements placed at the bottom of a trench and subsequently covered with an embankment.

In this known process, side elements are also used which are equipped at their base with a stabilization portion enabling them simply to be placed on the ground, standing upright without any scaffolding, and supporting an upper element in the form of an inwardly curved vault which is joined tangentially to the side elements so that the loads applied are transmitted by arching to the side elements and as far as a plane raft enabling the stresses to be distributed over a large surface.

Consequently, the precast elements described in EP 081,402 were provided in order to transmit the forces tangentially, not to sustain substantial lateral stresses. For this reason, could not be used without adaptation for the construction of semi-buried structures on a mountainside.

In particular, each covering element consists of a shell in the shape of a cylindrical sector associated with at least one transverse stiffening rib formed on the intrados of the shell and extending in a plane perpendicular to the axis, the whole forming a substantially undeformable rigid piece cast in a single piece from reinforced or prestressed concrete.

As a result, the arched shape of the curvature is preserved, which makes it possible better to absorb the load of the embankment and the impacts resulting from landslides, but the rigidity afforded by the rib enables the spacing of the lateral edges to be retained and the loads to be transmitted to the side elements in essentially vertical directions via articulated bearings which are formed on opposite horizontal faces of the upper element and of the bearing stringers.

Such an articulated-portal structure better withstands the lateral forces which are occasionally exerted in the event of landslides or avalanches.

However, the lateral edges of the covering element are subjected to substantial vertical forces and must therefore be capable of being reinforced.

To this end, each covering element can be provided, along its two parallel longitudinal edges, respectively with two strengthening longitudinal beams bearing on the upper stringers of the side elements, and the articulated longitudinal bearings consist of matching portions formed, respectively recessed and projecting, on the opposite horizontal faces of the longitudinal beams of the covering element and of the stringers of the side elements.

It is likewise advantageous for the uphill side element to consist of an inwardly curved wall joined tangentially to the cylindrical shell of the covering element. In this case, the inwardly curved wall is equipped, at its upper end and on the side of the extrados, with a widened portion of triangular cross-section comprising a horizontal face on which is formed the corresponding portion of the articulated bearing.

Given that the covering element is simply placed on top of the upper stringers of the side elements, its width is not necessarily limited to the spacing of the stringers and can advantageously be extended, at least on the downhill side, by a portion extending in cantilevered fashion from the corresponding lateral bearing edge and comprising a section of a cylindrical shell associated with at least one stiffening rib extending between the extrados of the upper element and of the extension, perpendicularly to the axis and on either side of the lateral bearing edge.

The space between the natural terrain and the side element placed nearest the top of the incline is preferably filled with relatively loose backfill material, and the whole is covered with topsoil as far as the opposite lateral edge of the upper element.

BRIEF DESCRIPTION OF THE DRAWINGS

The invention will be more clearly understood with the aid of the following description of a particular embodiment given by way of example and shown in the attached drawings.

DESCRIPTION OF PREFERRED EMBODIMENTS

Figure 1:
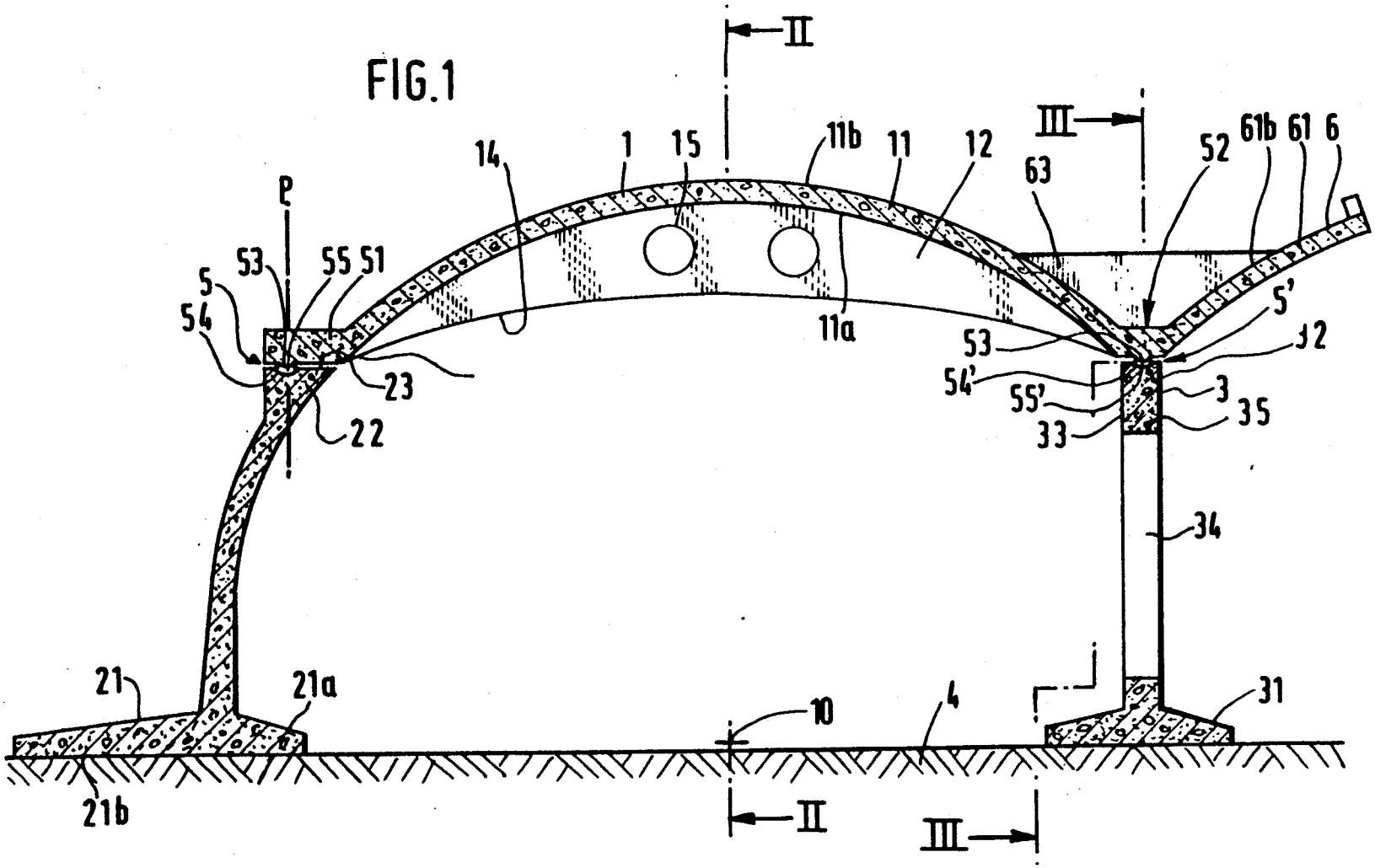
FIG. 1 is a front elevation view, in cross-section, of a structure constructed according to the invention.
Figure 3:
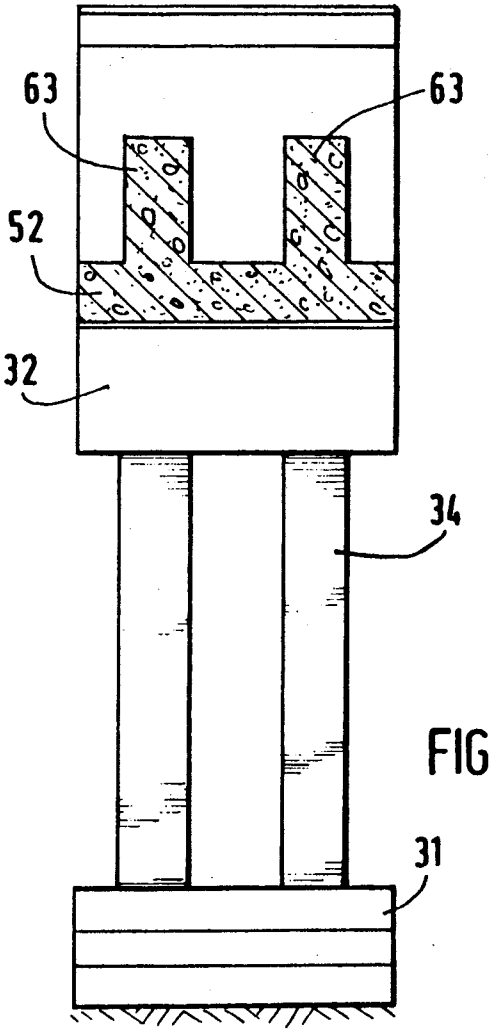
FIG. 3 is a section view along III—III in FIG. 1.
Figure 2:
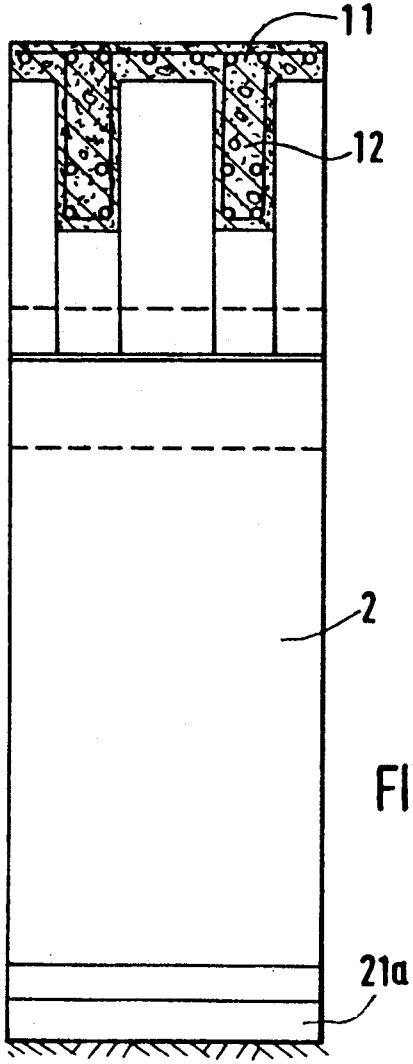
FIG. 2 is a section view along line II—II in FIG. 1.

The structure shown in FIG. 1 comprises an upper element 1 placed on two side elements, respectively an uphill element 2 and a downhill element 3, each resting on the ground via a footing 21, 31. All the elements are made from reinforced or prestressed concrete.

There is no need for any anchoring in the ground and any foundation work, the two side elements 2 and 3 being simply placed on the subgrade 4 by their footings 21, 31 which are provided in order to enable them to stand upright without any scaffolding.

The upper covering element 1 consists of a concrete shell in the shape of a sector of a cylinder of revolution centered on a longitudinal axis 10 and provided, on its intrados 11*a*, with two transverse ribs 12 which extend in planes perpendicular to the longitudinal axis 10. Furthermore, along its two lateral edges 13, 13′ parallel to the axis 10, the upper element 1 is provided with two strengthening longitudinal beams 51, 52, bearing respectively on stringers 22, 32 formed on the upper ends of the side elements 2 and 3, via articulated longitudinal bearing members 5, 5′.

In the illustrated embodiment, each uphill side element 2 consists of a solid wall curved inwards and extending, in a substantially vertical direction, from the base 21.

The curvature of the inwardly curved wall 2, at least at its upper end, is equal to that of the cylindrical shell 1, so that the elements join tangentially.

However, in order to enable the side element 2 to absorb the vertical forces applied on bearings 5, the upper end of the element 2 is widened on the side of the extrados by a portion 22 having a horizontal upper face 23 and in which the reinforcement necessary to withstand the forces applied can be placed, the upper end 22 thus forming a strengthening stringer with a substantially triangular cross-section.

The stringer 22 is normally cast in a single piece with the side element 2. It could, however, consist of an attached girder placed and sealed on the upper end of the element 2.

Each bearing member 5 consists of two complementary portions 53, 54 respectively projecting and recessed on the opposite faces of the longitudinal beams 51, 52 and of the stringers 22, 32, or vice versa.

The lower face of each longitudinal beam 51, 52 of the covering element is, for example, provided with a rib 53 of convex rounded profile engaging in a groove 54 formed on the upper face 23 of the stringer 22 (32) of the side element, 2 (3).

Sealing strips 55 (55′), for example made of neoprene, can advantageously be placed between the two portions 53, 54 bearing on each other.

The upper element 1, stiffened by the ribs 12 and the longitudinal beams 51, 52, constitutes a rigid, substantially undeformable assembly cast in a single piece. Consequently, even when it is loaded with an embankment, the upper element 1 transmits to the side elements 2 and 3 only vertical forces passing through the mid planes P, P′ of the bearing members 5, 5′.

The whole structure thus forms an articulated portal resting on the footings 21, 31 which can be designed in order to withstand occasionally the horizontal forces resulting from landslides or from the passage of avalanches, the vertical forces being dominant.

The inner portion 21*a* of the footing 21 of the side element 2 can thus extend sufficiently inwards from the bearing plane P to give the element 2 stability. Furthermore, the outer portion 21*b* of the footing 21 can advantageously be considerably extended outwards in order to contribute toward the stability of the element 2 by a spade effect when it is loaded with an embankment.

It will also be noted that, when the elements 2 are inwardly curved, the stringer 22 enables the plane P of application of the bearing forces to be displaced outwards.

The upper element 1 can simply cover the space between the side elements 2 and 3. The longitudinal beams 51 and 52 are then identical. However, in the preferred embodiment shown in the drawings, the upper element 1 is provided on one side with a covering extension 6 consisting of an inwardly curved shell 61 extending in cantilevered fashion from the longitudinal beam 52. The shell 61 can have the shape of a cylindrical sector of the same radius as the shell 11, so that the stringers of the two vaults form an assembly which is symmetrical with respect to the bearing longitudinal beam 52.

Moreover, one or more transverse ribs 63, perpendicular to the longitudinal axis 10, are formed at the top, between the extrados 11*b* and the extrados 61*b*, in order to join together the two vaults 11 and 61. The upper element 1 thus constitutes a rigid assembly which is cast in a single piece from reinforced or prestressed concrete and which comprises the vault 11 and its extension 6, the ribs 12 and 63 and the longitudinal beams 51 and 52. The dimensional features of the cylindrical shells and of their ribs, as well as the reinforcements, are determined in order to form an assembly which is both rigid and light and is capable of sustaining without deformation its own weight and the weight of a bank of limited thickness.

The longitudinal bearing member 5' of the longitudinal beam 52 of the upper element on the side element 3 is likewise symmetrical with respect to the vertical plane P', the groove 54' being formed on the upper face 33 of the longitudinal beam 32 which therefore does not need to be widened like the longitudinal beam 22 of the side element 2.

Figure 4:
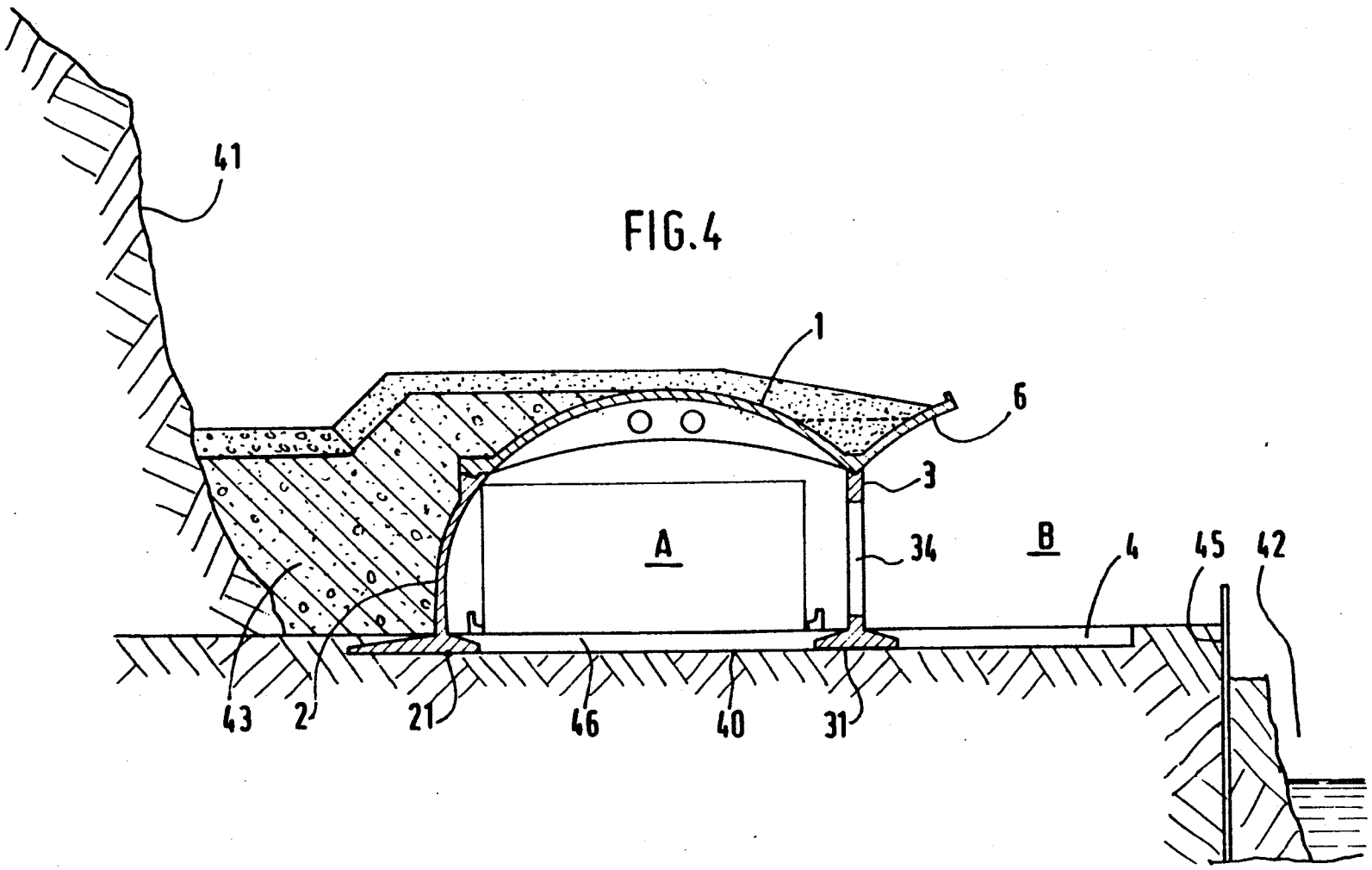
FIG. 4 is a schematic view, in cross-section, of a highway constructed on a mountainside on a flattened and compacted subgrade 4.

The structure which has just been described is particularly suited to the construction of a coast road, as has been shown in FIG. 4.

The precast elements 1, 2, 3 can advantageously be made in a precasting factory, possibly far away from the building site. Indeed, their dimensions in the longitudinal direction can be limited to the width of a truck trailer in order to enable them to be transported. The highway, which can have two parallel lanes A and B, is placed on a subgrade 40 formed on a mountainside.

In order to build the tunnel, after having formed the subgrade 4, possibly over a reduced length in order to reduce the risks of landslides, firstly a certain number of uphill elements 2 are placed in alignment, followed by the downhill elements 3 and lastly the covering elements 1.

The side of the subgrade 4 nearest to the top of the incline can be excavated and, if the type of earth permits it, the uphill face 41 can be substantially vertical in order to limit the area taken up and the volume of excavated materials. Indeed, the workers benefit, once the uphill elements 2 have been put in place, from a degree of protection against landslides which are caught between the mountain 41 and the element 2. This protection is further improved by the inwardly curved shape of the wall 2. When the structure has been built over a certain length, the highway can be constructed in sheltered conditions.

For a two-lane highway, the downhill element 3 is placed substantially at the center of the subgrade 4. However, because there are no foundations and because the load is effectively distributed by the footing 31, the side element 3 could be placed, in the case of a narrow lane, very near the downhill edge of the subgrade 4.

The highway 46 is constructed in a conventional manner, it being possible for the inner portions of the footings 21 and 31 to constitute a restraint and to support sidewalks, if necessary.

The invention could take alternative forms. The side element 2 placed nearest the top of the incline is, for example, advantageously inwardly curved in order better to withstand the pressure of the earth and in order to protect a sidewalk, but it could also consist of a plane wall extending vertically from the footing 21.

The dimensions and the reinforcement of the various elements are determined in order to withstand the forces and, in particular, in order to give the upper element 1 the desired rigidity without increasing its weight excessively. In particular, as shown in the drawings, the lower face 14 of the rib 12 can be inwardly curved in order to make the assembly lighter and in order to make available a larger clearance limit. However, in certain applications, for example dwellings or industrial buildings, the lower face 14 could be horizontal in order to facilitate the placing of a ceiling, it then being possible for the ribs 12 to be thinner.

Orifices 15 permitting the passage of ducts, lines and various circuits could also be formed in the ribs 12.

Moreover, the structure according to the invention could have other applications, for example for the construction of walls for protection against noise in an urban environment. In this case, the construction of an embankment and of a bank of topsoil above the structure would remain advantageous for its noise-absorption effect and from an aesthetic point of view.

A structure of the same type could also be used for the construction of semi-buried buildings, for example on hillsides in tourist sites, such buildings, which may be covered with gardens, blending in well with the countryside and being effectively protected against possible landslides or winter avalanches.

What is claimed is:

1. A semi-buried covered structure for protecting a subgrade extending on a mountainside along a longitudinal axis, said structure being constructed entirely from precast concrete elements and being constituted by a succession of adjacent sections positioned sequentially along said longitudinal axis, each of said sections consisting of three precast elements, namely, (a) two side elements, respectively placed on both sides of said subgrade, including an uphill side element and a downhill side element, each of said side elements comprising (i) a base in the form of a widened footing with a plane lower face enabling said side element simply to be placed on ground;

(ii) a substantially vertical wall; and (iii) an upper portion in the form of a longitudinal stringer; and (b) an upper covering element consisting of a shell in the shape of a cylindrical sector associated with at least one transverse stiffening rib formed on an inner side of said shell and extending in a plane perpendicular to said longitudinal axis and forming a substantially undeformable rigid unitary piece with said upper covering element;

(c) said substantially vertical wall of said uphill side element being solid and inwardly curved, an outer side of said upper portion comprising a widened portion of triangular cross section forming said longitudinal stringer and comprising a horizontal face on which is formed a corresponding portion of one of said articulated bearings of said covering element.

2. The covered structure as claimed in claim 1, wherein said structure has an open downhill side, said wall of each said downhill side element being constituted by at least one pillar extending vertically between said base and said upper stringer of said side element.

3. The covered structure as claimed in claim 1, wherein said covering element has two parallel longitudinal edges bearing respectively on said upper stringers of said side elements, opposite faces of said longitudinal edges of said covering element and of said upper stringers of said side elements being provided respectively with corresponding longitudinal portions forming two articulated longitudinal bearings.

4. A semi-buried covered structure for protecting a subgrade extending on a mountainside long a longitudinal axis, said structure being constructed entirely from precast concrete elements and being constituted by a succession of adjacent sections positioned sequentially along said longitudinal axis, each of said sections consisting of three precast elements, namely, (a) two side elements, respectively placed on both sides of said subgrade, including an uphill side element and a downhill side element, each of said side elements comprising (i) a base in the form of a widened footing with a plane lower face enabling said side element simply to be placed on ground;

(ii) a substantially vertical wall; and (iii) an upper portion in the form of a longitudinal stringer; and (b) an upper covering element consisting of a shell in the shape of a cylindrical sector associated with at least one transverse stiffening rib formed on an inner side of said shell and extending in a plane perpendicular to said longitudinal axis forming a substantially undeformable rigid unitary piece with said upper covering element;

(c) said upper covering element having, on at least one side, a covering extension extending in cantilevered fashion from a corresponding lateral bearing edge and comprising a section of a cylindrical shell associated with at least one stiffening rib extending between outer sides of said upper covering element and of said extension, perpendicularly to said longitudinal axis and on either side of said lateral bearing edge.

* * * * *